US010875353B2

(12) United States Patent
Kasahara et al.

(10) Patent No.: US 10,875,353 B2
(45) Date of Patent: Dec. 29, 2020

(54) MANUFACTURING METHOD FOR DECORATED OBJECT

(71) Applicant: MIMAKI ENGINEERING CO., LTD., Nagano (JP)

(72) Inventors: Junki Kasahara, Nagano (JP); Akira Takatsu, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 241 days.

(21) Appl. No.: 15/853,861

(22) Filed: Dec. 25, 2017

(65) Prior Publication Data

US 2018/0194161 A1 Jul. 12, 2018

(30) Foreign Application Priority Data

Jan. 6, 2017 (JP) ..... 2017-001060

(51) Int. Cl.

| | |
|---|---|
| ***B44C 1/17*** | (2006.01) |
| ***B41M 3/12*** | (2006.01) |
| ***B41M 1/28*** | (2006.01) |
| ***B44C 1/14*** | (2006.01) |

(52) U.S. Cl.

CPC ..... *B44C 1/1737* (2013.01); *B41M 1/28* (2013.01); *B41M 3/12* (2013.01); *B44C 1/14* (2013.01); *B44C 1/1729* (2013.01); *B44C 1/1733* (2013.01)

(58) Field of Classification Search

CPC ..... B44C 1/1729; B44C 1/1733; B44C 1/14; B44C 1/1737; B41M 3/12; B41M 1/28

See application file for complete search history.

(56) References Cited

U.S. PATENT DOCUMENTS

| | | | | |
|---|---|---|---|---|
| 4,012,552 A | | 3/1977 | Watts | |
| 6,120,394 A | * | 9/2000 | Kametani | A63B 37/0003 101/492 |

FOREIGN PATENT DOCUMENTS

| | | |
|---|---|---|
| CN | 102039699 | 5/2011 |
| DE | 3430111 | 10/1985 |
| JP | S55139875 | 11/1980 |
| JP | S58160187 | 9/1983 |
| JP | S6151399 | 3/1986 |
| JP | H01113295 | 5/1989 |
| JP | H047141 | 1/1992 |
| JP | H10146913 | 6/1998 |
| JP | 2001096885 | 4/2001 |

(Continued)

OTHER PUBLICATIONS

Machine translation of JP 55-139875; Publication date: Apr. 17, 1979; Inventor: Suzuki Hisanori.*

(Continued)

*Primary Examiner* — Vishal I Patel
(74) *Attorney, Agent, or Firm* — JCIPRNET

(57) ABSTRACT

A manufacturing method for a decorated object is provided. In this manufacturing method, a foil is attached to a medium to obtain the decorated object. The manufacturing method includes: a foil layer forming step of attaching the foil to an adhesive layer formed on the medium, so as to form a foil layer in a manner that the adhesive layer is partly exposed; and an ink layer forming step of applying an ink to the foil layer on which the adhesive layer is partly exposed, so as to form an ink layer in a manner that the ink contacts an exposed part of the adhesive layer.

16 Claims, 7 Drawing Sheets

(56) References Cited

FOREIGN PATENT DOCUMENTS

| | | |
|---|---|---|
| JP | 2012533760 | 12/2012 |
| JP | 2013236050 | 11/2013 |

OTHER PUBLICATIONS

"Office Action of China Counterpart Application," with English translation thereof, dated Aug. 28, 2019, p. 1-p. 13.
"Search Report of Europe Counterpart Application", dated May 4, 2018, p. 1-p. 7.
"Office Action of China Counterpart Application", dated Apr. 13, 2020, with English translation thereof, p. 1-p. 11.
"Office Action of Japan Counterpart Application", dated Jun. 9, 2020, with English translation thereof, p. 1-p. 7.

* cited by examiner

MANUFACTURING METHOD FOR DECORATED OBJECT

CROSS REFERENCE TO RELATED APPLICATIONS

This application claims the priority benefit of Japanese Patent Application No. 2017-001060 filed on Jan. 6, 2017. The entirety of the above-mentioned patent application is hereby incorporated by reference herein and made a part of this specification.

TECHNICAL FIELD

This disclosure relates to a manufacturing method for a decorated object. In this method, a foil is attached to a medium to be decorated to obtain a decorated object.

DESCRIPTION OF THE BACKGROUND ART

There are known manufacturing methods for recorded objects (for example, Japanese Unexamined Patent Publication No. 2013-236050). According to the methods, an ink for mask formation is applied in advance by an inkjet printer to a recording medium, to which a film will be transferred, to form a mask on the recording medium, so that the film is not transferred to a mask-coated part of the recording medium. Then, the film is transferred to a part of the recording medium which is not coated with the mask.

As illustrated in FIG. 7, the recorded object 100 described in Japanese Unexamined Patent Publication No. 2013-236050 includes a recording medium 110, a coloring ink 111 applied to the recording medium 110, a mask 120 formed from an ink for mask formation, a film 130 transferred to a part of the recording medium 110 which is not coated with the mask 120, and a coloring ink 112 applied to the film 130 on the recording medium 110. The film 130 includes a foil 131 and an adhesive layer 132. The adhesive layer 132 serves to attach the foil 131 to the recording medium 110.

SUMMARY

In the method described in Japanese Unexamined Patent Publication No. 2013-236050, the coloring ink 112 is applied to the surface of the foil 131 transferred to the recording medium 110. Thus, this method may produce diverse colors without using a plurality of different foils. The coloring ink 112, however, may possibly be repelled by the foil 131 and poorly adhere to the foil 131 depending the type of the foil 131 used. This may disturb a pattern desirably obtained from the coloring ink 112.

The coloring ink 112 solidified (cured, dried) and attached to the foil 131 may possibly easily come off when, for example, hit by some kind of object from outside. Thus, effective means are being sought and are desirably found that can enhance an adhesive strength between the coloring ink 112 and the foil 131.

To address the issue of the known art, this disclosure is directed to providing a manufacturing method for a decorated object in which an adhesive strength is enhanced between a foil of any type and an ink(s) applied to the foil.

This disclosure provides a manufacturing method for a decorated object. This method attaches a foil to a medium to manufacture the decorated object, and includes: a foil layer forming step of attaching the foil to an adhesive layer formed on the medium, so as to form a foil layer in a manner that the adhesive layer is partly exposed; and an ink layer forming step of applying an ink to the foil layer on which the adhesive layer is partly exposed, so as to form an ink layer in a manner that the ink contacts an exposed part of the adhesive layer.

According to this configuration, the adhesive layer and the ink layer contact each other in a part of the foil layer where the adhesive layer is exposed. This may enhance an adhesive strength between the foil layer and the ink layer. The ink layer in contact with the adhesive layer as well as with the foil layer is hardly detached from the foil layer. The ink layer may also serve as a protective layer that protects the exposed part of the adhesive layer.

The foil layer forming step may include: an attaching step of attaching a foil-attached sheet to the adhesive layer, wherein the foil-attached sheet is a release sheet with one surface of a foil attached thereto; and a detaching step of detaching the release sheet from the foil, subsequent to the attaching step.

According to this configuration, the foil layer may have holes and/or peeled-off parts which are formed when the release sheet is detached from the foil-attached sheet. The holes and/or peeled-off parts thus formed may allow the ink layer to contact and closely adhere to the adhesive layer. The manufacturing method further including these steps may be an effective means for decorating an object by using such a foil-attached sheet and removing the release sheet after the foil is attached to the adhesive layer.

The ink layer may have a higher degree of hardness than the adhesive layer.

According to this configuration, the adhesive layer is protected with the ink layer harder than the adhesive layer. In the case where the decorative portion (adhesive layer, foil layer, ink layer) of the object is hit by some kind of object from outside, the ink layer may serve as a protective layer for the adhesive layer and the foil layer and may accordingly prevent the foil layer from coming off.

The manufacturing method may further include an adhesive layer forming step of forming the adhesive layer on the medium in a manner that the adhesive layer has a surface with irregularities.

According to this configuration, by forming the adhesive layer with irregularities on its surface, the holes and/or peeled-off parts may be even more likely to be formed in the foil layer at the time of detaching the foil-attached sheet. This may further enhance an adhesive strength between the ink layer and the adhesive layer.

In the ink layer forming step, an ink with a pencil hardness greater than or equal to 2H in a solidified state may be used to foil the ink layer.

According to this configuration, such an ink may improve fastness properties of the decorative portion.

In the ink layer forming step, the ink applied to the foil layer may have a coverage of 30% to 60%.

According to this configuration, thus, the foil and the ink layer may present a markedly vivid color, and the decorated object may be improved in product quality. Such an ink coverage may accomplish a degree of reflection that promises the metallic texture of the metal foil and a degree of pigmentation that allows the produced color to be visually recognizable.

This disclosure further provides a decorated object in which a foil is attached to a medium. The decorated object includes: an adhesive layer formed on the medium; a foil layer formed on the adhesive layer; and an ink layer formed on the foil layer. The ink layer makes contact with the adhesive layer and the foil layer.

According to this configuration, by having the adhesive layer and the ink layer contact each other, an adhesive strength between the foil layer and the ink layer may be successfully enhanced.

This disclosure may increase an adhesive strength between the foil and the ink applied to the foil.

DESCRIPTION OF EMBODIMENTS

A preferred embodiment of this disclosure is hereinafter described in detail referring to the accompanying drawings. The embodiments are described below as examples of the art disclosed herein which are not limited and may be variously modified within the scope of this disclosure.

Structure of Decorated Object

Figure 1:
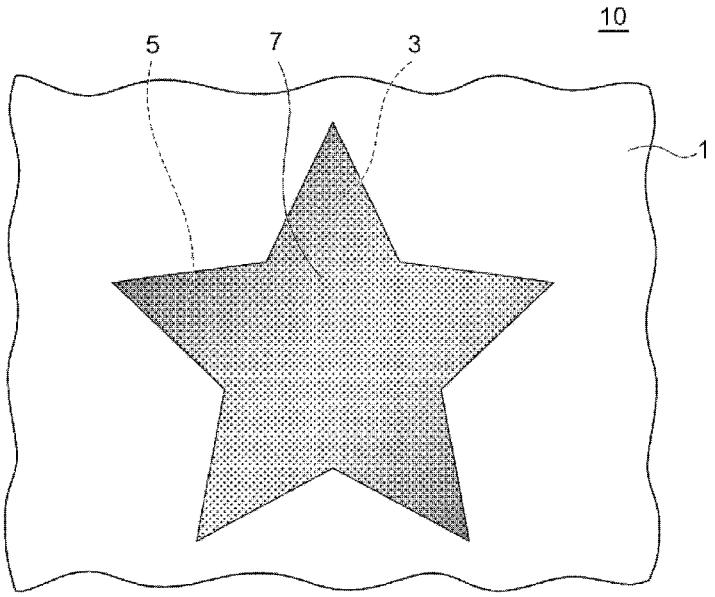
FIG. 1 is a plan view of a decorated object manufactured by a method according to an embodiment of this disclosure.
Figure 2:
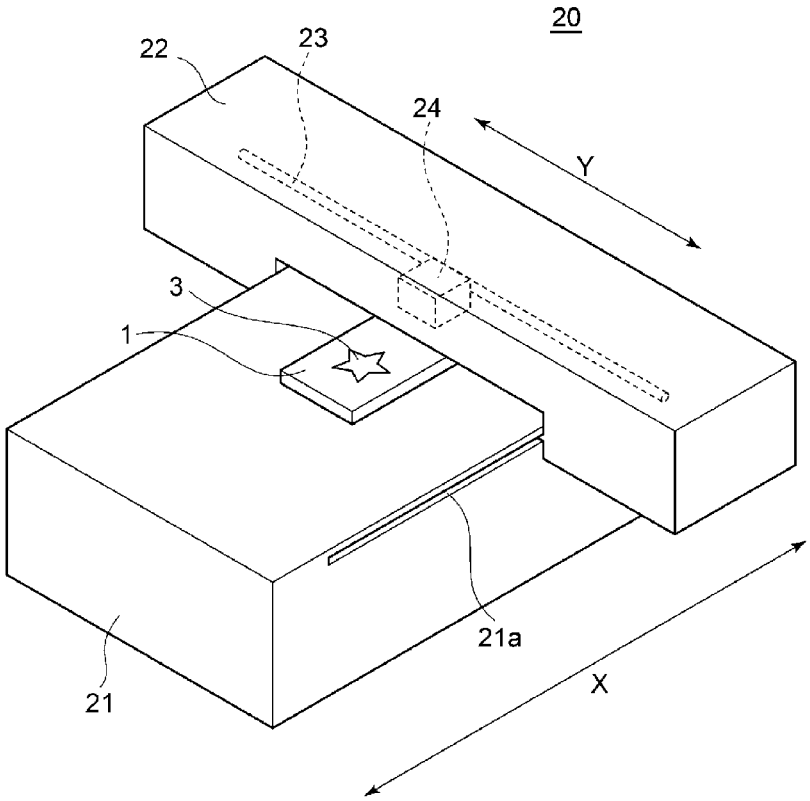
FIG. 2 is a perspective view of an inkjet printer used to manufacture the decorated object illustrated in FIG. 1.
Figure 3A:
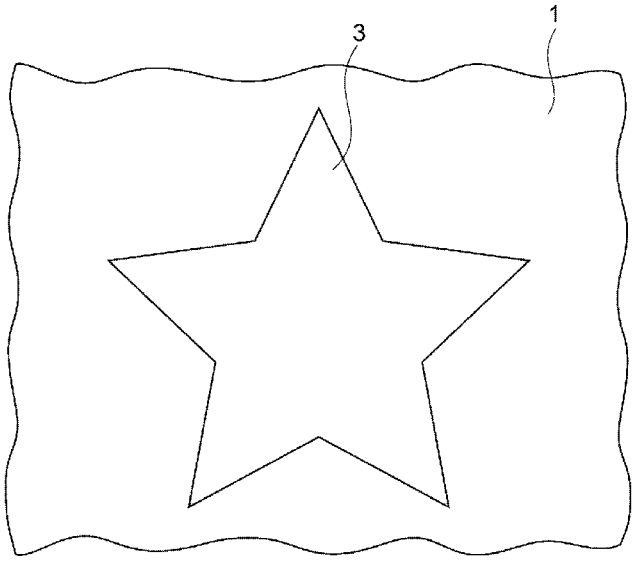
FIGS. 3A and 3B are drawings that illustrate a step of forming an adhesive layer in the process to manufacture the decorated object.
Figure 3B:
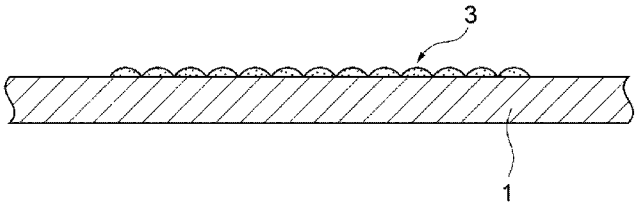
Figure 4A:
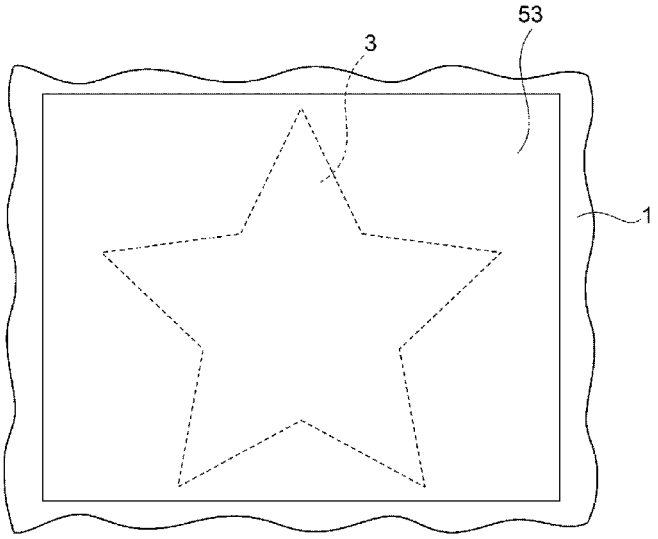
FIGS. 4A and 4B are drawings that illustrate a step of forming a foil layer in the process to manufacture the decorated object.
Figure 4B:
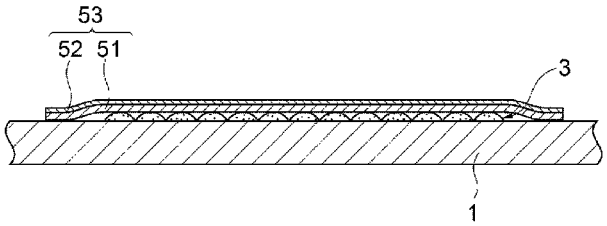
Figure 5A:
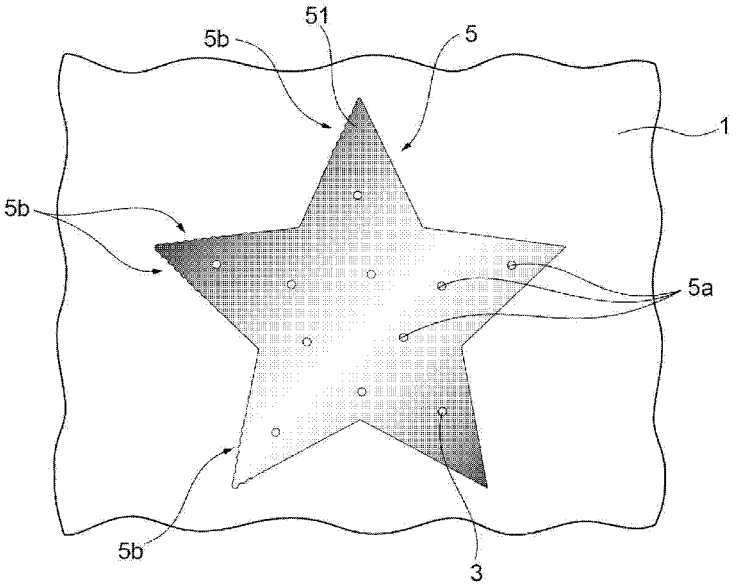
FIGS. 5A and 5B are drawings that illustrate a step of detaching a release sheet in the process to manufacture the decorated object.
Figure 5B:
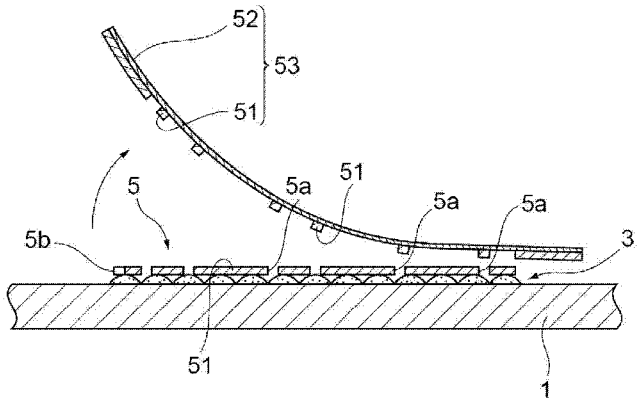
Figure 6A:
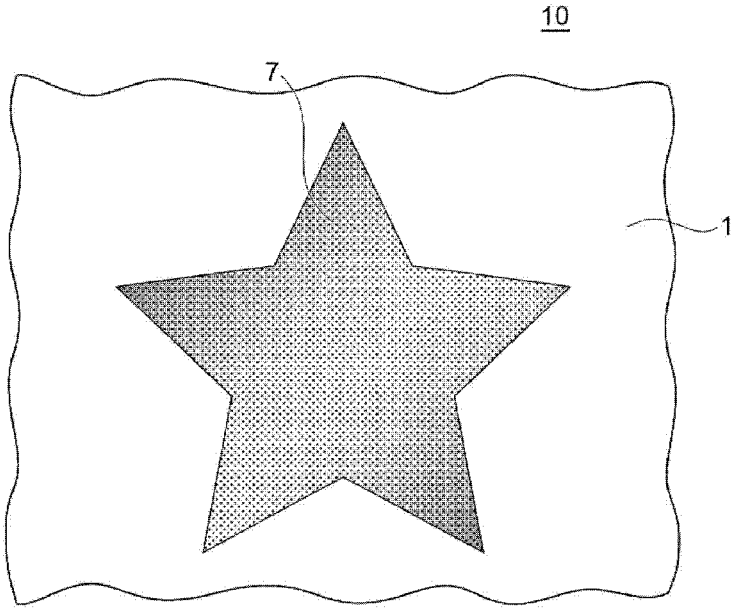
FIGS. 6A and 6B are drawings that illustrate a step of forming an ink layer in the process to manufacture the decorated object.
Figure 6B:
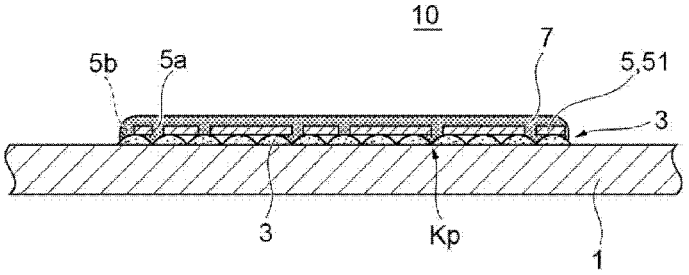
Figure 7:
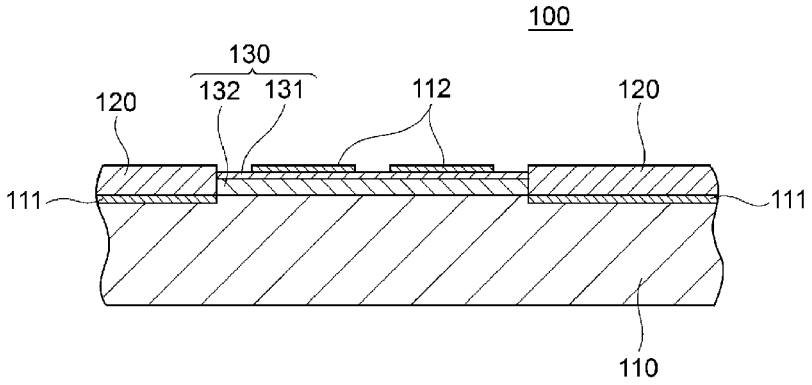
FIG. 7 (RELATED ART)
FIG. 7 is a drawing that illustrates a conventional manufacturing method for a decorated object.

FIG. 1 is a plan view of a decorated object manufactured by a method according to an embodiment of this disclosure. FIG. 2 is a perspective view of an inkjet printer used to manufacture the decorated object illustrated in FIG. 1. FIGS. 3A and 3B are drawings that illustrate a step of forming an adhesive layer. FIG. 3A is a plan view of a medium with an adhesive layer formed thereon. FIG. 3B is a cross-sectional view of the medium. FIGS. 4A and 4B are drawings that illustrate a step of forming a foil layer. FIG. 4A is a plan view of a medium with a foil-attached sheet attached thereto. FIG. 4B is a cross-sectional view of the medium. FIGS. 5A and 5B are drawings that illustrate a step of detaching a release sheet. FIG. 5A is a plan view of a medium with a foil layer formed thereon. FIG. 5B is a cross-sectional view of the medium, illustrating a process to detach the release sheet. FIGS. 6A and 6B are drawings that illustrate a step of forming an ink layer. FIG. 6A is a plan view of a decorated object with an ink layer formed thereon. FIG. 6B is a cross-sectional view of the decorated object.

As illustrated in FIG. 1, a decorated object 10 includes a medium to be decorated (hereinafter, medium) 1, an adhesive layer 3 constituting an underlayer (primer layer), a decorative foil layer 5, and an ink layer 7. In the decorated object 10, a decorative foil 51 (that forms the foil layer 5) is attached to the medium 1, and for example, a colored ink or a colorless ink may be applied (ejected) to the surface of the foil 51.

Medium

The medium 1 is a recording medium on which the adhesive layer 3, foil layer 5, and ink layer 7 are formed. The medium 1 may be one optionally selected from the known recording media. Examples of the material of the medium 1 which are not limited and may be plastic, SUS, metal such as brass, glass, stone, and fabric. The medium 1 may have an optional shape such as a flat board or a film.

Adhesive Layer

A coating material that becomes tacky in a solidified (cured) state is used to form the adhesive layer 3. The coating material is more specifically a coating material (ink) having tacky properties and solidifiable (curable) by being irradiated with ultraviolet light. The coating material having tacky properties is applied by an inkjet printer to the medium 1 and irradiated with ultraviolet light to form the adhesive layer 3. The coating material having tacky properties may be a colorless-transparent material including acrylate as a binder resin.

To form the adhesive layer 3, the coating material having tacky properties that just landed on the medium 1 is immediately irradiated with ultraviolet light and solidified (cured). The adhesive layer 3, therefore, is not a smooth layer but is a layer with irregularities, as illustrated in FIGS. 3A and 3B. A printing mode conventionally called matte mode is employed to form adhesive layer 3. In this printing mode, the coating material having tacky properties is solidified (cured) before starting to spread on the medium 1. The adhesive layer 3 thus obtained has irregularities on its surface.

The material of the adhesive layer 3 is not limited to ultraviolet-solidifiable (curable) coating material, but the material of the adhesive layer 3 may be selected from thermally-solidifiable (curable) coating materials. Other examples of the material of the adhesive layer 3 may include coating materials that become tacky by heating after being solidified.

Foil Layer

The foil layer 5 formed on the adhesive layer 3 may include, for example, a sheet of foil 51. While the material of the foil 51 is not particularly limited, the foil 51 may be one selected from metal foils made of metallic materials and pigment foils made of pigments.

One surface of the foil 51 is attached to a release sheet 52, such as a paper or film. After the foil 51 is pressed against the adhesive layer 3, the release sheet 52 is removed to leave the foil 51 alone attached to the adhesive layer 3.

Examples of the material of the foil 51 are not limited and may include single metals such as gold, silver, platinum, copper, tin, and aluminum, and alloys of these metals.

As illustrated in FIG. 1, the foil layer 5 constitutes a decorative portion on the medium 1. The foil layer 5 illustrated in FIG. 1 has a star-like shape in plan view, which is an example not limited. Examples of the shape of the foil layer 5 may include shapes such as circular, triangular, rectangular, and pentagonal shapes, letters, characters, and symbols, or the mentioned examples may be optionally combined and used.

As illustrated in FIGS. 5A and 5B, the foil layer 5 has, in part, holes 5*a* and peeled-off parts 5*b* that allow the adhesive layer 3 to be exposed. The release sheet is removed after the foil 51 is pressed against the adhesive layer 3. At the time, the foil 51 is removed with partially attached to the release sheet. This may leave the holes 5*a* and the peeled-off parts 5*b* in the foil layer 5. At positions on the foil layer 5 where the holes 5*a* and the peeled-off parts 5*b* are formed, the adhesive layer 3 below the foil layer 5 (closer to the medium 1) is exposed on the upper side (toward the foil layer 5). The ink layer 7 which is described below and formed on the foil layer 5 makes contact with the adhesive layer 3 at least through the holes 5*a* and the peeled-off parts 5*b* thus formed in the foil layer 5.

Ink Layer

To form the ink layer 7, color inks having, for example, cyan, magenta, yellow, white, and black colors may be applied onto the foil layer 5. The ink layer 7 closely contacts the foil layer 5 and also contacts, at least in part, the adhesive layer 3 through the holes 5*a* and peeled-off parts 5*b*.

The ink layer 7 is formed from color inks with a degree of hardness (pencil hardness) of 2H to 5H in a solidified (cured) state. The "pencil hardness" complies with JIS K 5600-5-4, testing methods for paints, mechanical property of film, scratch hardness (pencil method).

To form the ink layer 7, the color inks may be ejected onto the foil layer 5 to an extent that the coverage of the inks (coating region) relative to the whole surface of the foil layer 5 is between 30% and 60%.

When the color inks are used in the ink layer 7, the colors of these inks may be combined with the color of the foil 51 to produce unique coloration. In the case where the foil 51 has a metallic color such as silver, and the yellow ink is used for the ink layer 7, a metallic yellow color may be produced.

Manufacturing Method for a Decorated Object

Next, a manufacturing method for a decorated object is described referring to FIGS. 2 to 6B. In this method, the foil 51 is attached to the medium 1 to obtain the decorated object 10.

Adhesive Layer Forming Step

An operator immovably locates the medium 1 at a predetermined position on a table 21 of an inkjet printer 20, and then inputs instructions to the inkjet printer 20 to record an image on the medium 1 based on optional printing data using an adhesive material (coating material having tacky properties).

In the inkjet printer 20 that received the instructions inputted by the operator, the carriage 24 is moved in a main scanning direction illustrated with an arrow Y relative to the table 21 along a guide rail 23, and a printer body 22 is moved relative to the table 21 along a guiding mechanism 21*a* in a sub scanning direction illustrated with an arrow X. That is, in the inkjet printer 20, the carriage 24 is moved relative to the medium 1 secured to the table 21 in accordance with the printing data (see FIG. 2).

The inkjet printer 20 prompts a recording head mounted in the carriage 24 to eject the adhesive material (coating material having tacky properties) toward the medium 1 secured to the table 21, and prompts an ultraviolet irradiation device (UVLED) mounted in the carriage 24 to irradiate ultraviolet light toward the coating material having tacky properties on the medium 1. That is, the inkjet printer 20 ejects the coating material having tacky properties by inkjet printing in the shape of an image based on the printing data (for example, star-like shape) to form the adhesive layer 3 of this material on the medium 1 (see FIGS. 3A and 3B). The adhesive layer 3 is printed in the matte mode, in which the coating material having tacky properties applied to the medium 1 is solidified (cured) before starting to spread and flatten on the medium 1. The adhesive layer 3 thus formed has a surface with irregularities.

Foil Layer Forming Step

After the adhesive layer 3 is formed, the operator adheres a foil-attached sheet 53, which is the release sheet 52 with the foil 51 attached thereto, to the surface of the adhesive layer 3 formed on the medium 1. Specifically, the foil 51-attached surface of the foil-attached sheet 53 is put on the adhesive layer 3, and the foil-attached sheet 53 is pressed against the adhesive layer 3 with a tool such as a roller or a brush. The foil 51 thus closely adheres to the adhesive layer 3 due to the tackiness (adhesiveness) of the adhesive layer 3 (see FIGS. 4A and 4B).

After the foil 51 is pressed against the adhesive layer 3, the operator detaches the release sheet 52 from the medium 1, as illustrated in FIG. 5B. Most of the foil 51 of the foil-attached sheet 53 is attached to the adhesive layer 3 with the tackiness of the adhesive layer 3. When the release sheet 52 is removed, therefore, the foil 51 is left on the adhesive layer 3 and forms the foil layer 5. The remaining part of the foil 51 failing to adhere to the adhesive layer 3 is left on and remains attached to the release sheet 52 of the foil-attached sheet 53.

When the foil layer 5 is formed by thus detaching the release sheet 52 from the medium 1, the foil 51 attached to the release sheet may be partly removed with the release sheet 52 at some positions on the adhesive layer 3. That is, at the positions on the adhesive layer 3 where the foil 51 is not attached, the holes 5*a* may be formed, as well as the peeled-off parts 5*b* lacking the foil 51 at an edge portion of the foil layer 5, as illustrated in FIGS. 5A and 5B. Therefore, the adhesive layer 3 below the foil layer 5 is exposed through the holes 5*a* and the peeled-off parts 5*b* (see FIGS. 5A and 5B).

Ink Layer Forming Step

The operator immovably locates the medium 1 with the foil layer 5 formed thereon at the same position on the table 21 of the inkjet printer 20 as in the adhesive layer forming step, and then inputs instructions to the inkjet printer 20 to record an image on the foil layer 5 of the medium 1 using the ultraviolet-solidifiable (curable) color inks. The image formed then is based on the printing data and is shaped equally to the adhesive layer 3.

As illustrated in FIG. 6A, the inkjet printer 20 applies the color inks to the whole foil layer 5 to form the ink layer 7 thereon. The color ink droplets that form the ink layer 7 then are in contact with the adhesive layer 3 through the holes 5*a* and the peeled-off parts 5*b*, as illustrated in FIG. 6B.

The color inks applied to the foil layer 5 by inkjet printing may be solidified (cured) with short time and form points of contact Kp with the adhesive layer 3.

In the decorated object 10 manufactured in the steps described so far, the color ink droplets that form the adhesive layer 3 and the ink layer 7 are in contact through the holes 5*a* and the peeled-off parts 5*b* of the foil layer 5. This may increase an adhesive strength between the foil layer 5 and the ink layer 7. The ink layer 7 in contact with the adhesive layer 3 as well as with the foil layer 5 is hardly detached from the foil layer 5.

The holes 5*a* and the peeled-off parts 5*b* formed in the foil layer 5 at the time of removing the foil-attached sheet 53 may serve to more closely attach the ink layer 7 to the adhesive layer 3. When the adhesive layer 3 has irregularities on its surface, particularly, the holes 5*a* and the peeled-off parts 5*b* may be even more likely to be formed at the time of removing the foil-attached sheet 53. Therefore, no additional means may be necessary to increase an adhesive strength between the foil layer 5 and the ink layer 7.

The ink layer 7 that covers the adhesive layer 3 including the foil layer 5 may play the role of a protective layer in the decorated object 10. Even in the case where the adhesive layer 3 has poor hardness, the adhesive layer 3 may be protected with the ink layer 7 relatively harder than the adhesive layer 3. Thus, even when the decorative portion (adhesive layer 3, foil layer 5, ink layer 7) of the decorated object is hit by some kind of object from outside, the ink layer 7 serving as a protective layer may prevent the foil layer 5 from coining off. When the color inks preferably with the hardness of 2H to 5H in a solidified (cured) state are used to form the ink layer 7, fastness properties of the decorative portion may be improved, which is preferable.

The foil 51 made of a metal material may impart an improved glossy effect to the decorated object 10. The color ink coverage between 30% and 60% on the foil 51 may allow the foil 51 and the ink layer 7 to present a markedly vivid color. This may further improve the decorated object 10 in product quality. Such an ink coverage may accomplish a degree of reflection that promises the metallic texture of the metal foil 51 and a degree of pigmentation that allows the produced color to be visually recognizable.

In the case where the color ink coverage falls below 30%, the reflection from the foil 51 may be too intense to visually recognize the color of the ink layer 7. In case the color ink coverage exceeds 60%, the feature of the foil 51 (metallic texture) may be concealed with the color inks.

Other Aspects

The medium 1 having the adhesive layer 3 already attached thereto may be used.

The ink for forming the ink layer 7 is not limited to color inks, and for example, a colorless-transparent clear ink may be used. The ink layer 7 using the clear ink may be useful as a protective layer (overcoat) that protects the adhesive layer 3 and the foil layer 5.

In the embodiment described thus far, the holes 5*a* and the peeled-off parts 5*b* are formed in the process to form the foil layer 5. However, both of the holes and peeled-off parts may not be necessary, insofar as at least the holes 5*a* or the peeled-off parts 5*b* are formed.

What is claimed is:

1. A manufacturing method for a decorated object, the manufacturing method attaching a foil to a medium to obtain the decorated object, comprising:

a forming step of an adhesive layer of applying a tacky coating and forming the adhesive layer having tackiness after solidification;

a forming step of a foil layer of attaching the foil to the adhesive layer formed on the medium, so as to form the foil layer in a manner that the adhesive layer is partly exposed from holes or defective portions of the foil;

a forming step of an ink layer of applying an ink to the foil layer on which the adhesive layer is partly exposed from the holes or the defective portions, so as to form the ink layer in a manner that the ink in a liquid state contacts the adhesive layer partly exposed from the holes or the defective portions; and a forming step of the ink solidification for solidifying the ink.

2. The manufacturing method for the decorated object according to claim 1, wherein the foil layer forming step comprising:

an attaching step of attaching a foil-attached sheet to the adhesive layer, wherein the foil-attached sheet is a release sheet with one surface of a foil attached thereto; and a detaching step of detaching the release sheet from the foil, subsequent to the attaching step.

3. The manufacturing method for the decorated object according to claim 1, wherein the ink layer has a higher degree of hardness than the adhesive layer.

4. The manufacturing method for the decorated object according to claim 1, further comprising:

the forming step of the adhesive layer of forming the adhesive layer on the medium in a manner that the adhesive layer has a surface with irregularities.

5. The manufacturing method for the decorated object according to claim 1, wherein in the forming step of the ink layer, an ink with a pencil hardness greater than or equal to 2H in a solidified state is used to form the ink layer.

6. The manufacturing method for the decorated object according to claim 1, wherein in the forming step of the ink layer, the ink applied to the foil layer has a coverage of 30% to 60%.

7. The manufacturing method for the decorated object according to claim 2, wherein the ink layer has a higher degree of hardness than the adhesive layer.

8. The manufacturing method for the decorated object according to claim 2, further comprising:

the forming step of the adhesive layer of forming the adhesive layer on the medium in a manner that the adhesive layer has a surface with irregularities.

9. The manufacturing method for the decorated object according to claim 3, further comprising:

the forming step of the adhesive layer of forming the adhesive layer on the medium in a manner that the adhesive layer has a surface with irregularities.

10. The manufacturing method for the decorated object according to claim 2, wherein in the forming step of the ink layer, an ink with a pencil hardness greater than or equal to 2H in a solidified state is used to form the ink layer.

11. The manufacturing method for the decorated object according to claim 3, wherein in the forming step of the ink layer, an ink with a pencil hardness greater than or equal to 2H in a solidified state is used to form the ink layer.

12. The manufacturing method for the decorated object according to claim 4, wherein in the forming step of the ink layer, an ink with a pencil hardness greater than or equal to 2H in a solidified state is used to form the ink layer.

13. The manufacturing method for the decorated object according to claim 2, wherein in the forming step of the ink layer, the ink applied to the foil layer has a coverage of 30% to 60%.

14. The manufacturing method for the decorated object according to claim 3, wherein in the forming step of the ink layer, the ink applied to the foil layer has a coverage of 30% to 60%.

15. The manufacturing method for the decorated object according to claim 4, wherein in the forming step of the ink layer, the ink applied to the foil layer has a coverage of 30% to 60%.

16. The manufacturing method for the decorated object according to claim 5, wherein in the forming step of the ink layer, the ink applied to the foil layer has a coverage of 30% to 60%.

* * * * *